United States Patent [19]

Borzoni

[11] Patent Number: 4,661,793

[45] Date of Patent: Apr. 28, 1987

[54] PLUG-IN FUSE ASSEMBLY WITH SPECIALLY CONFIGURED FUSE LINK

[75] Inventor: John M. Borzoni, Indian Rocks Beach, Fla.

[73] Assignee: Littelfuse, Inc., Des Plaines, Ill.

[21] Appl. No.: 784,231

[22] Filed: Oct. 4, 1985

Related U.S. Application Data

[63] Continuation-in-part of Ser. No. 640,841, Aug. 17, 1984.

[30] Foreign Application Priority Data

Aug. 15, 1985 [JP] Japan ..... 60-180382

[51] Int. Cl.[4] ..... H01H 85/16

[52] U.S. Cl. ..... 337/260; 337/264; 337/295

[58] Field of Search ..... 337/260, 264, 255, 295

[56] References Cited

U.S. PATENT DOCUMENTS 4,344,060 8/1982 Giesemier et al. ..... 337/260

*Primary Examiner*—Harold Broome

*Attorney, Agent, or Firm*—Russell E. Hattis; Stephen R. Arnold

[57] ABSTRACT

A plug-in fuse assembly comprises a housing made of insulating material and having relatively closely spaced vertical side walls bridges by vertical end walls and a metal plug-in fuse element having laterally spaced, generally parallel confronting terminals at the bottom thereof projecting downwardly from the bottom of said housing and upwardly extending current-carrying extensions of said terminals and a unique S-shaped fuse link extending between said current-carrying extensions. The S-shaped fuse link has about a 45° angled upper and lower leg of at least about one-half the length of the central leg thereof and a width to thickness ratio of about ½ or less which maximizes its volume without the position contraints placed on the fuse link.

14 Claims, 11 Drawing Figures

PLUG-IN FUSE ASSEMBLY WITH SPECIALLY CONFIGURED FUSE LINK

RELATED APPLICATION

This application is a continuation-in-part application of U.S. Ser. No. 640,841, filed Aug. 17, 1984.

DESCRIPTION

1. Technical Field of Invention

This invention relates to improvements in the configuration of fuse links, such as those disclosed in U.S. Pat. Nos. 3,909,767, 3,962,782, 4,099,320, and other patents.

2. Background of the Invention

Both the fuse of the invention and those disclosed in these patents preferably, but not necessarily, comprise an all fuse metal plug-in fuse element formed by stamping the same from a strip of fuse metal. The stamping forms a pair of laterally spaced juxtaposed, parallel terminal blade portions to be received by pressure clip terminals in a mounting panel, current-carrying extensions at the inner end portions of the pair of terminal blade-portions and a fuse link portion of very small cross-sectional area interconnecting the current-carrying extensions. The shape, placement, length and/or thickness of the fuse link determines the current rating of the fuse. As in the case of most fuses, they are designed to blow quickly under short circuit conditions, or with a minimum desired delay for lower overload current ratings (like after 0.080 seconds for a 350% overload). This time delay before a fuse blows is affected by the mass or volume of the fuse link. It is generally desired to increase this time delay at high overload conditions.

Generally, the method of making such a plug-in fuse assembly, and as disclosed in said U.S. patents, comprises providing a strip of fuse metal which is progressively blanked or stamped to provide longitudinally spaced, interconnected fuse-forming sections or blanks having the desired fuse element configurations as described. The spaced pairs of terminal blades are interconnected by transverse, relatively rigid webs when the fuse links are fragile. The exposed transverse webs interconnecting the pairs of terminal blades add rigidity to the strip and securely maintain the relative positions of the pairs of terminal blades, the current-carrying extensions thereof and the more fragile interconnecting fuse link, until a housing or the like is inserted over and secured to each blank. The housing is most advantageously (i.e. but not necessarily) a single piece molding preferably of transparent material having an opening at one end thereof, preferably its bottom end, which enables the housing to be readily inserted over the end most blank of the strip before it is severed from the rest of the strip, with the terminal blade portions and web positioned outside of the housing. Before the web is removed therefrom, the housing may be staked into apertures in the current-carrying extensions of the fuse metal element.

The fuse development which is the subject of the above-identified patents represents a major advance in the design of automotive fuses because the construction thereof permits the reliable, automated, low cost production thereof, and it greatly reduced the overall size and volume of the fuses in comparison to those used previously for this purpose.

Low current fuses of the type described are especially difficult to mass produce reliably. Low current fuses generally have fuse links of small cross-sections. To obtain such a small cross section it was thought desirable to stamp the fuse link portion of the fuse from a portion of the fuse metal strip of reduced thickness obtained by skiving the fuse metal blank. Whether the fuse link was formed from such a reduced section or not the fuse links have heretofore had a thickness either smaller than the width of the fuse link or of the same order of magnitude. (To my knowledge there has not heretofore been provided a fuse link which for substantially its full length has a width much less than the fuse link thickness, which is one of the main features of the present invention.) The attainment of a desired time delay with these prior art low current fuses has made or required a lengthening of the fuse.

SUMMARY OF THE INVENTION

A novel and important feature of the invention relates to a uniquely sized, proportioned, and positioned fuse link which provides an increased mass (volume) of the fuse link to increase the fuse blowing time delay desired at high overload condition as described.

The new fuse link has throughout substantially its entire length an unusually narrow dimension, especially for fuse links which are stamped from a sheet of metal. For example, at the lower current ratings, it preferably has a width of the order of magnitude of a small as about 0.005" and the thickness thereof is the full thickness of the fuse metal strip from which it is stamped (e.g. 0.025") and so the strip is left unskived. Thus, the fuse link desirably has a width to thickness ratio much less than 1, such as no greater than ½, and preferably as small as about 1/5 for the lowest current rating.

The use of such a narrow filament-like fuse link provides a maximum possible median length and volume for the fuse link within the position constraints placed thereon. Thus, the curved portions of the fuse link should fall within a given rectangle which defines the closest permissible positioning of the curved portions of the fuse link to the adjacent portions of the housing and terminal blade extensions.

A low current-rated fuse element or link must inherently possess a relatively high resistance. Thus, the link must be of substantial length, small cross-section, or both.

For the lower current rated fuses, where the overall fuse link resistance must be much higher than it is at higher current levels to effect blowing of the fuse, the larger resistance is best achieved by having a fuse link configuration which is S-shaped. The unique S- shape of the fuse to be described, combined with the small width to thickness ratios as described, provide a unique fuse link configuration providing increased blowing time delay. The S-shaped configuration most advantageously has upper and lower legs thereof which incline upwardly and downwardly respectively away from the points of connection thereof to the central regions of the current carrying extensions of the terminal blades. The angle of inclination is preferably of the order of magnitude of 45°. This contrasts with the almost horizontal upper and lower fuse link legs formed by the S and Z-shaped fuse links of other manufacturers and by some of the S-shaped links previously made by the assignee of this application.

The above and other features and advantages of the invention will become apparent upon making reference to the specification and claims to follow and the drawings.

DESCRIPTION OF THE PREFERRED EMBODIMENT OF THE INVENTION

Referring now more particularly to FIGS. 1-4, there is shown a preferred plug-in fuse assembly 2 of the invention. This assembly is made of only two component parts, namely an all metal plug-in fuse element 4, which is a single stamping from a strip of fuse metal, and a housing 6 which most advantageously is a single piece synthetic plastic molded part defining a space therein into which portions of the plug-in fuse element 4 extend and are secured in any suitable way, but most preferably by a cold staking and ultrasonic welding operation.

Figure 1:
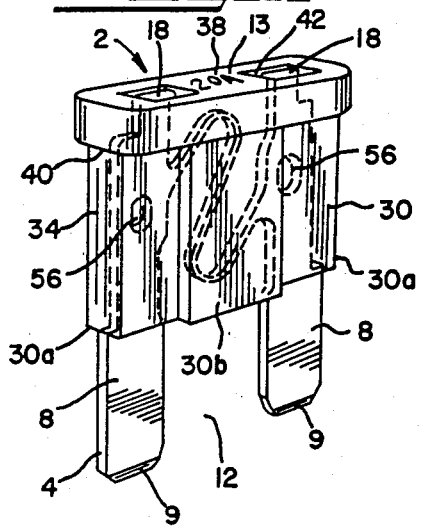
FIG. 1 a perspective view of a preferred form of the plug-in fuse assembly of the invention.
Figure 2:
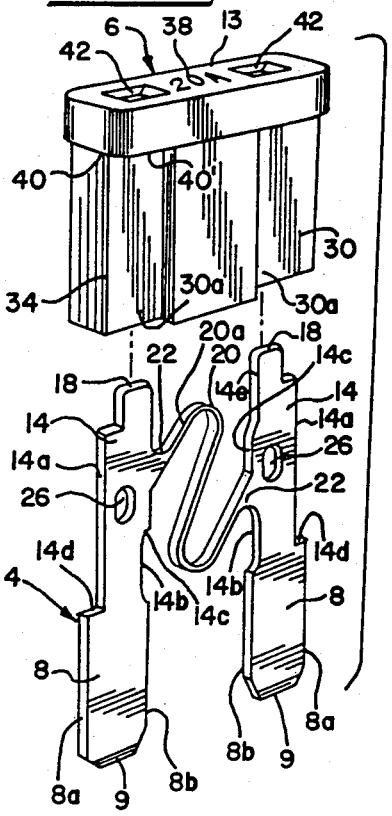
FIG. 2 is an exploded view of the housing and plug-in fuse element of FIG. 1.
Figure 4:
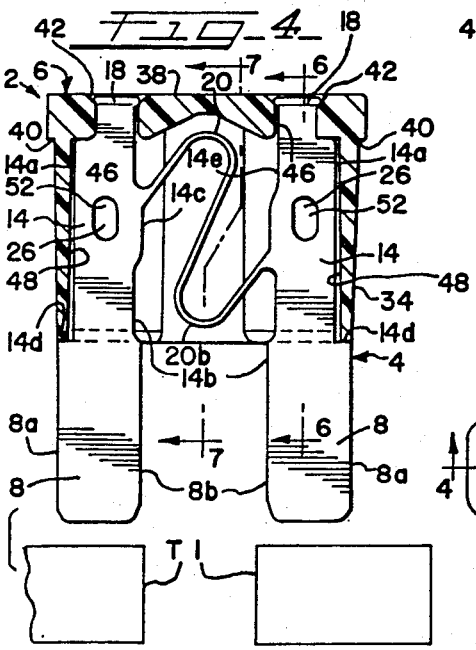
FIG. 4 shows in solid lines a vertical longitudinal sectional view through the plug-in fuse assembly shown in FIG. 3, taken along section line 4—4 therein, and pressure clip terminals therebelow designed for receiving the terminal blades of the predecessor fuse.
Figure 3:
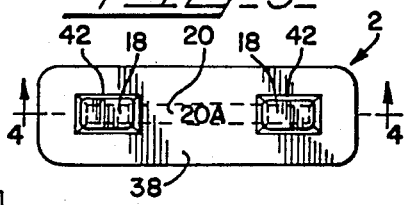
FIG. 3 is a top plan view of the plug-in fuse assembly of FIG. 1.

The plug-in fuse element 4 has terminal blade portions 8—8 plated with a highly conductive metal like tin and extending downwardly in spaced parallel juxtaposed relationship from the inner or bottom margin of the housing 6. The ends of the terminal blade portions 8—8 of the plug-in fuse element, which are spaced apart as indicated at 12, are most advantageously tapered at 9—9 to form pointed end portions which readily slip into place between the confronting walls of conventional spring clip terminals T1 (FIG. 4). The current rating of the plug-in fuse assembly as indicated by indicia 20 on the outer wall 38 of the housing and/or by a distinctive housing color.

The all metal plug-in element 4 may be formed from a partially or completely tin plated strip of fuse metal (not shown) from which longitudinally spaced interconnected fuse blanks are stamped. Prior to the plug-in fuse element being severed from the strip, the terminal blade portions 8—8 may be interconnected by a transverse rigidifying web (not shown) stamped from the strip. The stamping operation also forms the terminal blade portions 8—8 separated by a gap 12. The tapered portions 9—9 of the terminal blade portions 8—8 may be formed by coining dies preferably after the operation which severs the plug-in fuse element from the strip.

The terminal blade portions 8—8 have current-carrying extensions 14—14 which are also preferably tin plated including the outer end portions thereof where checking probe-receiving tabs 18—18 are formed. The current-carrying extensions project into the aforementioned space formed by the housing 6 where they are contiguous to the front or outer wall of the housing to be described. Especially for low current rated fuses, the current-carrying extensions 14—14 are preferably interconnected by an S-shaped fuse link portion 20 which is shown much narrower in width than it is thick. Except for this fuse link portion, the size and thickness of the rest of the plug-in fuse element is sufficient to form a rigid, self-supporting structure, as shown by the drawings. The current-carrying capacity of the fuse link portion 20 may be varied by varying its location and its configuration including its width, length and thickness dimensions. As indicated in the introduction hereto, the S-shaped fuse link illustrated is a uniquely proportioned fuse link to obtain a large time delay not used in the predecessor design. The current-carrying extensions 14—14 join the fuse-forming link portion 20 of the plug-in fuse element 4 by tapered portions 22—22. All of the various parts of the plug-in fuse element are shown substantially in coplanar relation. To anchor the plug-in fuse element 4 within the housing 6, oval-shaped staking of anchoring apertures 26—26 are formed in the current-carrying extensions 14—14 to receive anchoring projections to be described formed in the housing walls. These apertures are elongated in a direction parallel to the terminal blades to minimize the resistance increasing effects thereof.

The fuse link portion 20 shown in the drawings terminates in an upper leg **20*a* joining the left current-carrying extension 14 at a point above the staking aperture 26 therein. The fuse link portion 20 has a lower leg 20*b* which joins the right current-carrying extension 14 at a point below the associated staking aperture 26. The unique shape of this fuse link portion 20 will be later described. Thus, current which flows between the fuse link portion 20 and the left terminal blade portion will flow through the apertured portion of the left current-carrying extension while current does not do so in the apertured portion of the right current-carrying extension 14**. The basic configuration of the terminal blade and current-carrying extension portions are standardized for the different configurations used in the fuse link portions, so that common mechanical staking and ultrasonic welding equipment can be used for all fuses.

Figure 11:
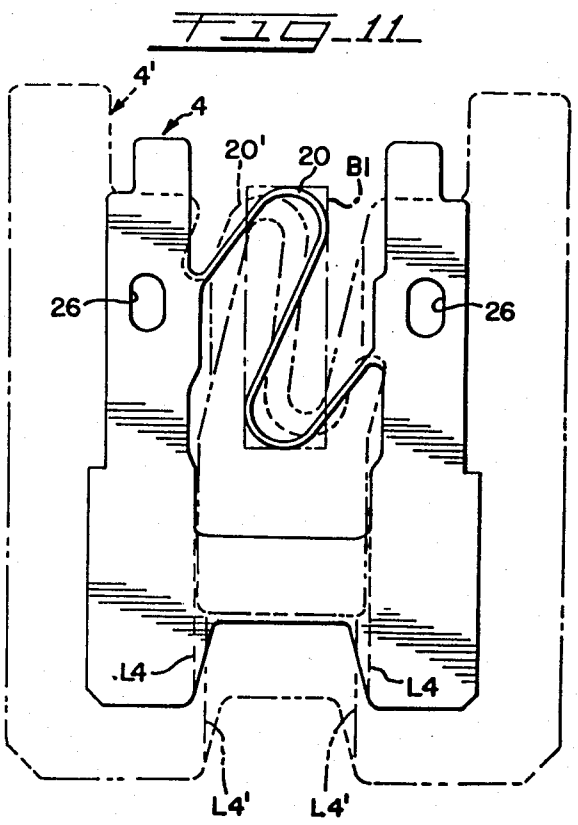
FIG. 11 is a view corresponding to that shown in FIG. 9 for 7½ amp rated fuses for the invention and predecessor fuse.
Figure 10:
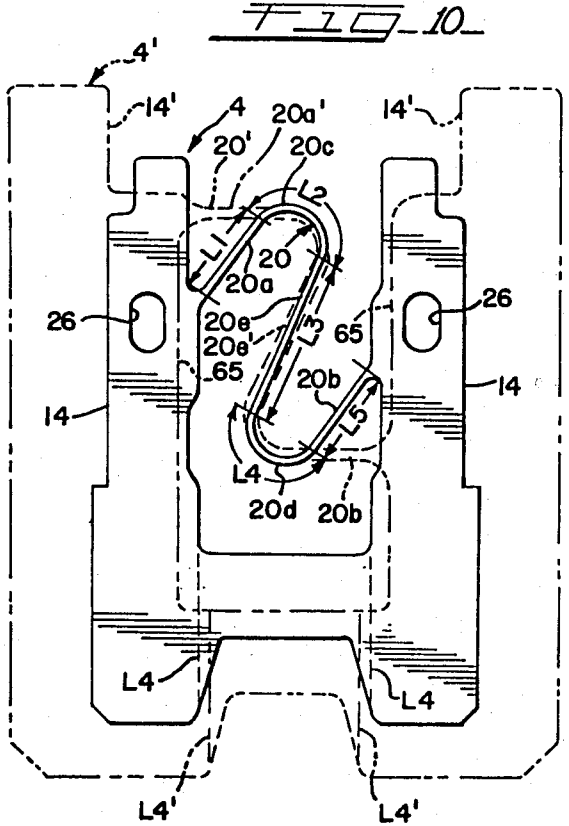
FIG. 10 shows in solid lines the outlines of the all metal plug-in fuse element of the fuse assembly of the present invention and in dashed lines the outline of the plug-in fuse element of corresponding predecessor larger fuse, for 5 amp rated fuses.

In accordance with the preferred form of the present invention as previously described, it is desired that the spacing between the confronting inner edges **8*b*—8*b* of the terminal blade portions 8—8 be similar and preferably somewhat larger than that of the much larger predecessor fuses which they were designed to replace, as best shown by FIGS. 10 and 11. Thus, FIGS. 10 and 11** show in solid lines the fuse 2 of the invention and in dashed lines the outlines of part of the larger fuse 2' which it replaced. FIG. 11 shows both fuse elements as formed by a punch and before assembly into their respective housings. Joining webs between the blades of each are left in place to insure rigidity during assembly, these webs being cut away thereafter along lines L4 and L4' respectively. Since, as there shown, the spacing between the confronting edges **8*b*—8*b* of the narrower terminal blade portions 8—8 of the fuse 2 of the present invention are spaced apart about the same and preferably a somewhat greater distance than the terminal blade portions 8'—8' of the larger fuse 2' it replaces, the fuse 2 is pluggable into the same but wider spring clip terminals T1 shown in FIG. 4, made for the larger fuse 2'** and, more importantly, will adapt to spring clip terminals of similar inner spacing but of smaller overall width and correspondingly reduced size fuse mounting blocks.

The confronting inner edges **8*b*—8*b* of the terminal blade portions 8—8 of the fuse 2 merge with inwardly offset vertical inner margins 14*b*—14*b* of the current-carrying extensions 14—14. The terminal blades 8—8 are preferably of a consistent width up to the point where that portion of the plug-in fuse element passes into the housing 6**. Maintaining this consistent width over the full length of these exposed terminal blades reduces the electrical resistivity where the fuse engages the external terminals, and increases the thermal conductivity and current-carrying capacity of the fuse.

The inwardly offset confronting margins **14*b*—14*b* of the current-carrying extensions 14—14 of the terminal blade portions 8—8 starting immediately above the terminal blade portions are provided to increase the spacing D1 (FIG. 8) between the lower loop of the fuse link portion 20 and the left current-carrying extension. This increases the width and mechanical strength of the portion of the manufacturing punch used to punch out this portion of the all metal plug-in fuse element 2 from the strip of fuse metal, as previously described in the introductory part of this application. It should be appreciated that the punch needed to punch out that portion of the all fuse metal plug-in fuse metal element 4 to the left of the fuse link portion 20 shown in FIG. 4 becomes especially weak if the punch becomes unduly narrow at the points thereof spaced substantially from the upper end thereof. For similar reasons, it is desirable to maximize the spacing between the upper loop of the fuse link portion 20 and the inner vertical margin of the upper end of the right current-carrying extension 14, that is along the inner vertical margin 14*e* of the right current-carrying extension 14**.

The upper ends of the offset inner vertical margins **14*b*—14*b* of the current-carrying extensions 14—14 are shown merging with laterally projecting portions 14*c*—14*c* at points horizontally opposite the anchoring apertures 26—26. The laterally projecting portions 14*c*—14*c*** of the current-carrying extensions are absent in the previous fuse for reasons to be explained.

As illustrated in FIGS. 4, 10 and 11, the current-carrying extensions 14—14 within the housing 6 have inwardly offset outer vertical margins **14*a*—14*a* forming upwardly facing stop shoulders 14*d*—14*d* and clearance spaces for the narrow end walls 34—34 of the housing 6. These end walls in previous fuse designs projected substantially horizontally beyond the vertical outer margins of the current-carrying extensions 14—14, as indicated by dashed line 6' in FIG. 4. The outer surfaces of the housing end walls 34—34 are close to or are in substantially vertical alignment with the outer vertical margins 8*a*—8*a* of the terminal blade portions 8—8 of the plug-in fuse element 4. The widths of the terminal blade portions 8—8 and the current-carrying extensions 14—14 of the exemplary fuse 2 of the invention illustrated in the drawings are preferably approximately one-half the width of the corresponding portions of the larger predecessor fuse 2' which the fuse 2 replaces. The laterally projecting portions 14*c*—14*c* of the current-carrying extensions 14—14 make up for part of the loss of metal caused by the inward offsetting of the outer vertical margins 14*a*—14*a* of the current-carrying extensions 14—14, so that a desired cross-sectional area of fuse metal material is present opposite the staking apertures 26—26 to avoid hot spots. If desired, these inwardly extending portions 14*c*—14*c*** could be extended inwardly much further than that shown in the drawing if necessary to eliminate unsatisfactory hot spots, and the thickness of the fuse metal could be increased, if desired.

Exemplary specifications for a 5 amp rated fuse are as follows:

- width of current-carrying extensions 14—14 below the apertures 26—26 and the inwardly extending portions **14*c*—14*c***=0.080 inches
- width of current-carrying extensions 14—14 at the aperture 26—26=0.094" inches
- vertical dimensions of apertures 26—26=0.062 inches
- width of apertures 26—26=0.037 inches
- thickness of fuse metal=0.025 inches
- width of fuse metal=0.005 inches
- fuse metal resistivity=40 ohms/circular mil-foot at 20° C.
- overall vertical height of blades and extensions 14 and 18=0.585 inches
- housing composition=Polycarbonate resin (General Electric 141 RR-112 resin) or Polysulphone resin (Union Carbide P 1700 resin) or polyethersulfone (VICTREX 4100, ICI Americas, Inc.)

It will be recalled that a basic unique feature of the invention has to do with the design of the preferably S-shape fuse link portion 20 of the all fuse metal plug-in fuse element 4. To best understand this uniqueness, reference should be made to FIG. 10 which shows the all fuse metal plug-in fuse element 4' of the larger predecessor 3 amp fuse (the lowest reliable current rated fuse previously sold for automotive purposes) and the correspondingly rated all fuse metal plug-in fuse element 4 of the preferred form of the fuse of the present invention. It will be noted that the Z-shaped fuse link 20' of the predecessor fuse element 4' has straight horizontal upper and lower end portions or legs **20*a*' and 20*b*' joining the current-carrying extensions 14'—14' near the upper or lower ends thereof, whereas the upper and lower legs 20*a* and 20*b* of the preferred fuse link of the present invention incline preferably at an angle of about 45 degrees and join the current-carrying extensions 14—14 at points in the central portions thereof near but above and below the left and right staking apertures 26—26 respectively. The fuse link portion 20 has a straight central leg 20*e* extending at inclined angles corresponding to that of the straight central leg 20*e*' of the predecessor fuse and similar to the angles of inclination of the outer legs 20*a* and 20*b* thereof. The overall length of the fuse link portion 20 is thus substantially greater than the overall length of the fuse link portion 20'** of the predecessor fuse.

As previously indicated, the width of the fuse link portion 20 is exceedingly small, being preferably only a small fraction of the thickness of the metal from which the plug-in fuse element 4 is stamped. This has the advantage of providing a fuse link of a maximum overall median length so that for a fuse link of a given overall cross-sectional area there is a maximum mass or volume of fuse link material, increasing the time delay characteristics of the fuse. In FIG. 11 there is a dashed rectangular box B1 which defines the outermost extremities of the curved portions of the desired fuse link where there is a minimum acceptable spacing between the knee or curved portions of the fuse link and the adjacent portions of the fuse housing and current-carrying extensions 14—14'. If an S-shaped fuse link portion encompassing the same area defined by the box B1 were to have a much greater width than that shown in solid lines for a given fixed overall fuse link cross sectional area, the median length and overall volume of the fuse link material involved would be much less than that of fuse link portion 20, resulting in a smaller time delay before the fuse would blow. It was surprising to find that fuse links 0.005" wide could be reliably stamped from fuse metal blanks. This is not believed readily possible with materials other than a zinc-tin alloys conventionally used in fuses of the kind illustrated.

The fuse link portion 20 of the 5 amp fuse of FIG. 10 has the same median path length and shape as (but a different thickness than) that of the fuse link portion 20 of the 7½ amp fuse of FIG. 11. It is noted also that the fuse link portion 20' for the 7½ amp predecessor fuse shown in dashed lines in FIG. 11 has a completely different shape and width than the S-shaped fuse link portion 20 of FIGS. 10 and 11 and Z-shaped fuse link portion 20' of the prior 5 amp fuse shown in FIG. 10.

Figure 8:
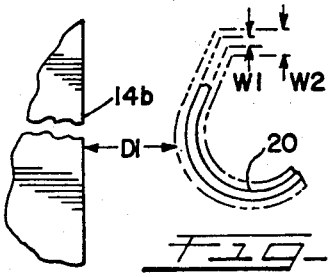
FIG. 8 is a fragmentary elevational view showing in solid lines a portion of one current-carrying extension and the adjacent portion of the S-shaped fuse link of the lowest amperage fuse, and shows in dashed lines the greater width of the fuse link used in the highest amperage fuses.
Figure 9:
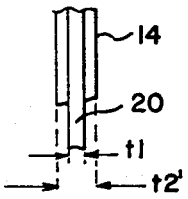
FIG. 9 a view of the smallest and highest amperage fuse links shown in FIG. 8 as viewed at right angles thereto.

In general, as the current ratings of the fuses of the present invention increase from 5 amps, as best shown in FIG. 8, the distance D1 (FIG. 8) between the looped portions **20*c* and 20*d* of the fuse link portion 20 of the fuse will decrease. The width of the low amperage fuse (such as 5 amps in the example of the invention described) is shown in dashed lines in FIG. 8 with a minimum width W1 and that of the highest amperage fuse is shown in solid lines with a maximum width W2, where the distance D1 between the fuse link and current-carrying extension is at a minimum. As previously indicated, this minimum distance D1 is limited so that the portion of the punch which forms this portion of the element can be readily made with adequate strength. Such a minimum distance may be, for example, 0.057". FIG. 9 shows the minimum and maximum thickness t1 and t2 respectively used for the lowest and highest amperage fuses. Exemplary thickness for t1 and t2** are 0.004" and 0.025", respectively.

The straight portions of the upper and lower fuse link legs **20*a* and 20*b* are desirably at least about ½ the length of the straight intermediate leg 20*e*** thereof.

FIG. 10 shows the fuse link segment lengths L1, L2, L3, L4 and L5 for the various contiguous segments of the S-shaped fuse link portion illustrated therein. These segment lengths may be 0.084", 0.108", 0.173", 0.108" and 0.084", respectively. While the overall length and time delay characteristics of the fuse link could be increased if the upper and lower legs 20 and **20*b* of the fuse link portion 20 joined the current-carrying extensions at points directly opposite the apertures 26—26, primarily because of the requirements of good tool design practices which would be violated under such circumstances, it was found desirable to shorten somewhat the overall length of the fuse link portion by connecting the upper and lower legs 20*a* and 20*b* to these extensions at points respectively above and below the apertures 26—26**.

The unique S-shaped configuration of the present invention also provides a most reliable fuse because it isolates to an optimum degree the central portion of the centermost leg where the fuse blows from the various heat generating portions of the fuse. Thus, the various legs of the preferred fuse link have relatively narrow and long profiles providing the maximum separation thereof. As shown in FIG. 11, this isolation is much greater in the case of the plug-in fuse element 4 of the invention than it is for the predecessor plug-in fuse element 4' where the outer end portions of the fuse filament 20' are spaced much closer to the center leg thereof.

Figure 5:
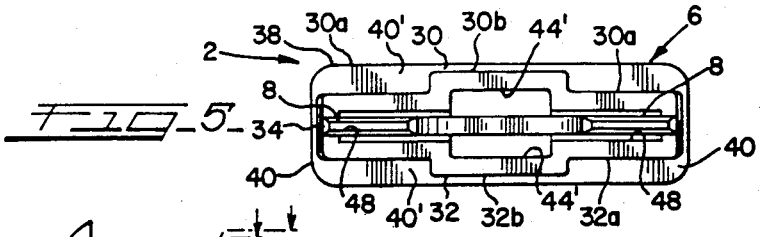
FIG. 5 is an enlarged bottom view of the plug-in fuse assembly of FIG. 1.
Figure 6:
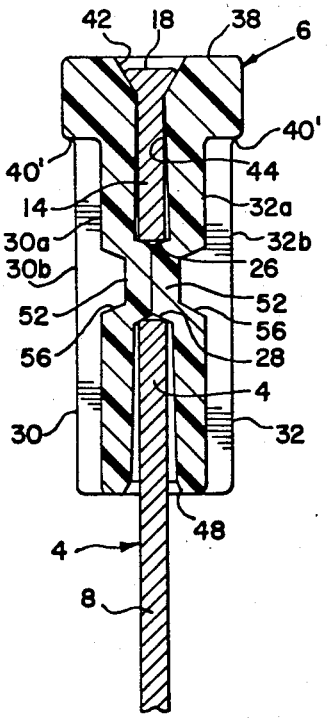
FIG. 6 is an enlarged transverse vertical sectional view through the plug-in fuse assembly shown in FIG. 4, taken along section line 6—6 thereof.
Figure 7:
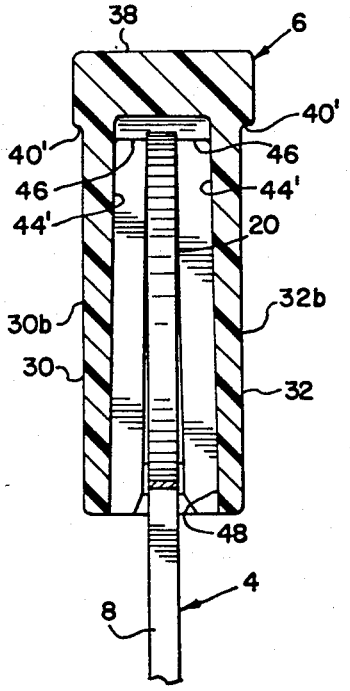
FIG. 7 is an enlarged vertical transverse sectional view through the center portion of the plug-in fuse assembly shown in FIG. 4, taken along section line 7—7 thereof.

While the housing 6 could be made in separate parts snappable or otherwise secured together to form a single piece at the time the housing is assembled, the housing is most advantageously a single piece integral molded part as shown. Also, it preferably has relatively closely spaced side walls generally indicated by reference numeral 30–32 (FIGS. 6–7), the side walls having end portions **30*a*–32*a* which are spaced together much more closely than the central or intermediate portions 30*b*–32*b* thereof. The side walls 30–32 are interconnected at their end margins by the narrow end walls 34—34 (FIG. 5), and at their outer or top margins by the outer wall 38 (FIG. 6) which overhangs the rest of the housing to form downwardly facing shoulders 40—40 at the longitudinal ends of the outer wall 38 and downwardly facing shoulders 40'—40' along the longitudinal side margins of the housing 6**.

Terminal access openings 42—42 are provided in the outer wall 38 adjacent the opposite end portions thereof in alignment with the location of the test probe-receiving tabs 18—18 of the plug-in fuse element 6. The walls of the terminal access openings 42—42 taper down to an inner dimension which approximates the width of the test probe-receiving tabs 18—18 so that test probes can be guided into contact with the tabs 18—18. The tabs 18—18 are preferably peened to further anchor the housing 6 to the plug-in fuse element 4. The terminal access openings 42—42 communicate with the aforementioned plug-in fuse element receiving space in the housing 4. The portions 44—44 of this space immediately beneath the access opening 42—42 are relatively small because of the close spacing of the side wall portions **30*a*–32*a* of the housing at these points, the width of the space portion 44—44 as viewed in FIG. 6 tapering from the bottom open end of the housing upwardly toward the terminal access openings 42—42, reaching a narrow dimension about equal to the thickness of the plug-in fuse element 4. At the inner margins of the terminal access openings 42—42 the upper wall 38 is provided with downwardly extending skirts 46—46 (FIG. 4) which act as shield walls to prevent spewing fuse metal from gaining entrance to the terminal access openings 42—42. These skirts 46—46 also increase the strength of the upper wall 38 which had to be thinned somewhat in the middle thereof to provide substantial spacing of the housing from the upper loop 20*c* of the fuse link 20**.

The fuse link portion 20 of the fuse element 4 is positioned in a relatively wide portion 44' (FIG. 7) of the housing interior, to provide for free circulation of air around the center portion of the fuse-forming link portion, which is the part thereof which first melts under excessive current flow, so heat does not accumulate which would adversely affect the current at which the fuse will blow.

The narrow and wide portions 44—44 and 44' of the space within the housing 6 open onto the bottom of the housing for the full extent thereof through an entry opening 48. The opening 48 permits the housing to be pushed over the end portion of the end blank of the pre-stamped and preferably milled strip from which a completed fuse element is punched and immediately following this operation the housing 6 is secured by staking to the end portion or end blank of the strip, as previously indicated.

The housing 6 is preferably a molded part made of a transparent synthetic plastic material so that the fuse link portion 20 of the plug-in fuse element 4 is readily visible through the housing walls.

While the housing interior could be made with resilient projections which snap into the anchoring apertures 26—26 in the plug-in fuse element 4, it is preferred to secure the housing in place by forming projections 52 from both sides of the housing 6 by first a mechanical staking operation, which projections enter the anchoring apertures 26—26 of the plug-in fuse element 4. The inwardly extending projections 52 formed by the mechanical staking operation where they engage each other in the anchoring apertures or openings 26 are preferably later ultrasonically welded together by ultrasonic welding or the like to provide a more rigid and structurally stable anchoring structure. The depressions 56 left by the staking operation are shown in the side wall 30 in FIGS. 1 and 6.

As previously indicated, the anchoring apertures 26—26 of the previous fuse design were rectangular in shape. However, to eliminate cracking of the synthetic plastic material in some cases due to the sharp corners of these apertures, it was found most desirable that this aperture be made of a vertically elongated oval shape. It is vertically elongated to minimize the width of the aperture to reduce the cross-sectional area of the current-carrying extensions 14—14 at this point to a more modest degree.

The exemplary embodiments of the fuse assemblies described have thus provided exceedingly compact plug-in fuse assemblies which can be readily inserted into and removed from suitable closely spaced spring clip terminal connectors in a mounting panel by manually grasping the shoulders 40—40 at the longitudinal ends of the housing 6 or by a tool which can engage these or the side shoulders 40'—40'.

It should be understood that numerous modifications may be made in the most preferred form of the invention described without deviating from the broader aspects of the invention. For example, while the invention has its most important application in the fuse having an all metal fuse plug-in element, some of the teachings of the invention are also applicable to fuses where fuse metal foil is placed over a core of insulation material or where the entire terminal blades are made of a metal other than fuse metal, the fuse link may be a separate element soldered or otherwise connected between the current-carrying extensions involved.

Also, for convenience of description, the fuse of the invention has been described and claimed with an assumed vertical orientation as shown in the drawings. However, it is to be understood that in use it may be mounted with other orientations, such as a horizontal orientation, which is commonly the case.

I claim:

1. In a conductive plug-in fuse element having laterally spaced, generally parallel confronting terminals at the bottom thereof, upwardly extending current-carrying extensions of said terminals and a fuse link which is to blow under overload current extending between points of support in a given plane on said current-carrying extensions, the improvement wherein said fuse link is of much smaller cross-section than said terminals and current-carrying extensions and has a double undulating configuration in said plane with an upper leg joined to and inclining away from said terminals in a given direction from a portion of the inner vertical margin of one of said current-carrying extensions at a point in the central region of such current-carrying extension and a lower leg joined to and inclining away in the opposite direction from the inner vertical margin of the other current-carrying extension at a pont in the central region of such current-carrying extension, and said fuse link has for substantially its entire length a width measured in said plane no greater than about ½ the thickness thereof measured transversely to said plane.

2. The plug-in element of claim 1 wherein said fuse link has a central leg connected by curved portions to said upper and lower end portions to form a general elongated S-shaped fuse link.

3. The plug-in element of claim 2 wherein said end portions and central leg are substantially straight.

4. The plug-in element of claim 3 wherein said end portions and central leg are inclined at a substantial angle to the length of the current-carrying extensions.

5. The plug-in fuse element of claim 1 combined with a housing made of insulating material having relatively closely spaced vertical side walls; said plug-in fuse element terminals project downwardly from the bottom of said housing, at least said current-carrying extensions and said fuse link being enclosed by said housing; housing anchoring.

6. The plug-in fuse assembly of claim 5 wherein said fuse link has a central leg connected by a curved portion to said upper.and lower end portion to form a generally elongated S-shaped fuse element.

7. The plug-in fuse assembly of claim 6 wherein said end portions and central leg are substantially straight.

8. The plug-in fuse assembly of claim 1 wherein said end portions and central leg are inclined at an angle of the order of about 45° to the length of the current-carrying extensions.

9. The plug-in fuse element or assembly of claim 1 or 5 wherein the length of said upper and lower end portions of the fuse link is at least about half the length of said central leg thereof.

10. The plug-in fuse element of claim 2 wherein said end portions and central leg are inclined at an angle of the order of about 45° to the length of the current-carrying extensions.

11. In a conductive fuse element a fuse link extending between points of support located in a given plane and which is to blow under overload current, said fuse link having an irregular shape measured in said plane to provide a path length substantially greater than the distance between said points, and said fuse link having for substantially its entire length a width measured in said plane no greater than about ½ the thickness thereof measured at right angles to said plane.

12. The fuse element of claim 1 or 11 wherein said fuse link is a stamping from a flat strip of fuse metal having the thickness of said fuse link.

13. The conductive fuse element of claim 11 wherein said irregular shape is a configuration which reverses in direction at least twice between the end portions thereof.

14. The conductive fuse element of claim 13 wherein said fuse link is a stamping from a flat strip of fuse metal having the thickness of said fuse link.

* * * * *